US006338290B1

(12) United States Patent
Lin

(10) Patent No.: US 6,338,290 B1
(45) **Date of Patent: *Jan. 15, 2002**

(54) POUNDING TOOL

(76) Inventor: Chung-Chiang Lin, No. 1, Lane 28, Tai Chou Street, He Nan Li, Hsi Chun Area, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/487,624

(22) Filed: Jan. 20, 2000

(51) Int. Cl.[7] ..... B25D 1/12
(52) U.S. Cl. ..... 81/22
(58) Field of Search ..... 81/20, 22, 489, 81/177.1

(56) References Cited

U.S. PATENT DOCUMENTS 811,390 A * 1/1906 Foreman ..... 81/489
4,738,166 A * 4/1988 Yamaguchi ..... 81/22
5,008,970 A * 4/1991 Tsai ..... 15/236.01
5,042,804 A * 8/1991 Uke et al. ..... 273/75
5,355,552 A * 10/1994 Huang ..... 16/111 R
6,170,362 B1 * 1/2001 Chen ..... 81/22

FOREIGN PATENT DOCUMENTS

GB 2275014 A * 8/1994 ..... 81/489

* cited by examiner

*Primary Examiner*—Joseph J. Hail, III
*Assistant Examiner*—David B. Thomas
(74) *Attorney, Agent, or Firm*—Browdy and Neimark

(57) ABSTRACT

A pounding tool comprises a pounding head and a handle fastened at one end thereof with the pounding head. The handle is provided in two opposite longitudinal sides thereof with a shock-absorbing block having a plurality of through holes for mitigating the shock wave that is transmitted to the handle from the pounding head at the time when the pounding head strikes an object.

8 Claims, 4 Drawing Sheets

POUNDING TOOL

FIELD OF THE INVENTION

The present invention relates generally to a hand tool, and more particularly to a pounding tool.

BACKGROUND OF THE INVENTION

As shown in FIG. 1, a pounding tool 50 of the prior art comprises a pounding body 51 and a handle 52 fastened at one end thereof with the pounding body 51.

The pounding body 51 is made of a metal material, whereas the handle 52 is made of a wooden material. The pounding body 51 is provided with a connection hole 511. The handle 52 is connected at one end thereof with the connection hole 511 of the pounding body 51. The handle 52 has an upper side 521 and a lower side 522. The direction formed from the upper side 521 to the lower side 522 is corresponding to the pounding direction of the pounding body 51.

The pounding is carried out with one hand holding the handle 52. As the pounding body 51 hits an object, a reaction force is transmitted via the handle 52 to the hand holding the handle 52. The reaction force often causes the paralysis of the hand holding the handle 52 of the pounding tool 50.

SUMMARY OF THE INVENTION

The primary objective of the present invention is to provide a pounding tool which is free from the drawback of the prior art pounding tool described above.

In keeping with the principle of the present invention, the foregoing objective of the present invention is achieved by a pounding tool comprising a pounding head and a handle fastened at one end thereof with the head. The handle is provided in an upper side thereof and a lower side thereof with a shock-absorbing block which is provided with a plurality of through holes for mitigating the reaction force transmitted to the handle from the pounding head.

The objective, features, and functions of the present invention will be more readily understood upon a thoughtful deliberation of the following detailed description of the embodiments of the present invention with reference to the accompanying drawings.

DETAILED DESCRIPTION OF THE INVENTION

Figure 1:
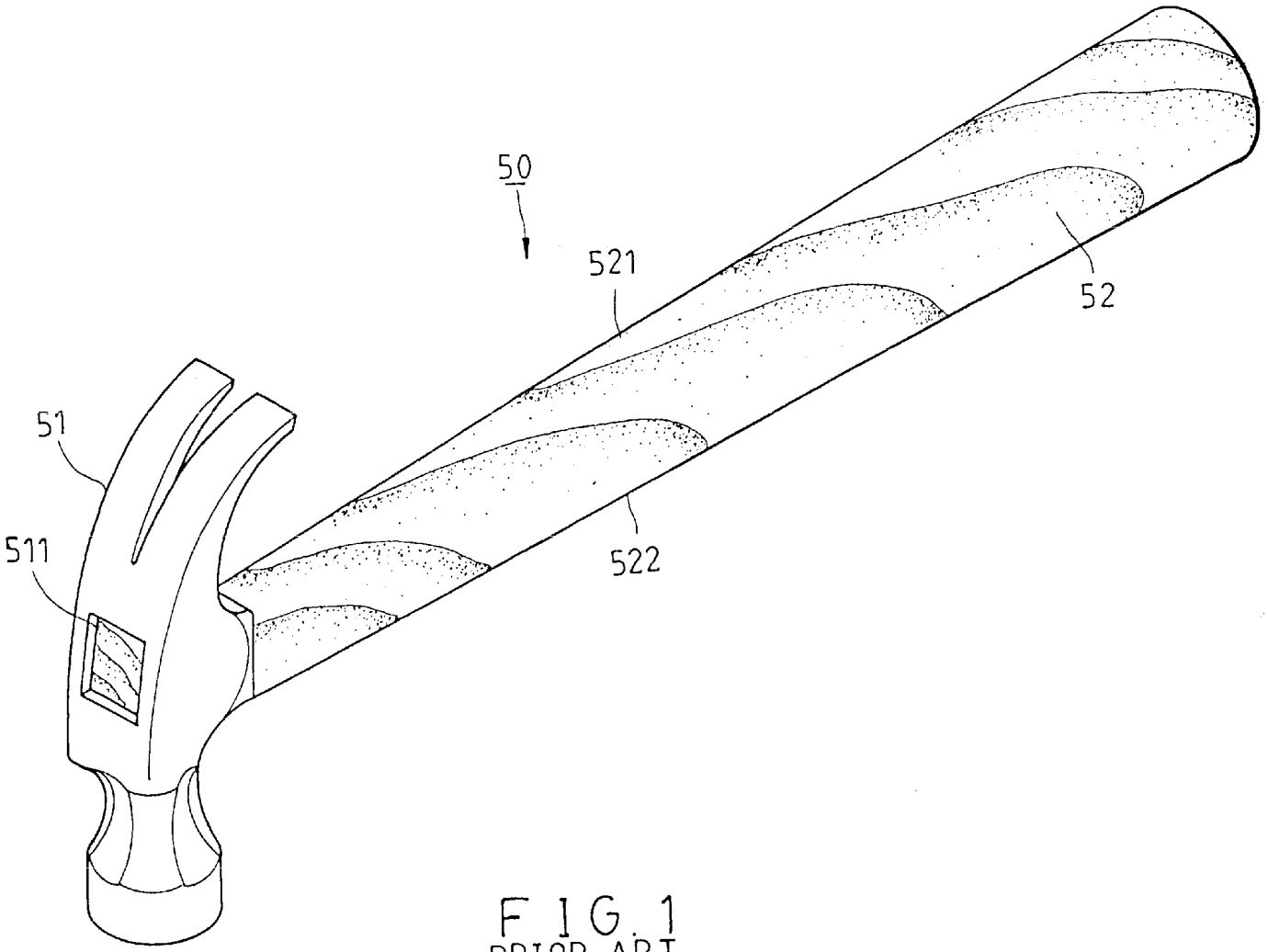
FIG. 1 PRIOR ART
FIG. 1 shows a perspective view of a pounding tool of the prior art.
Figure 2:
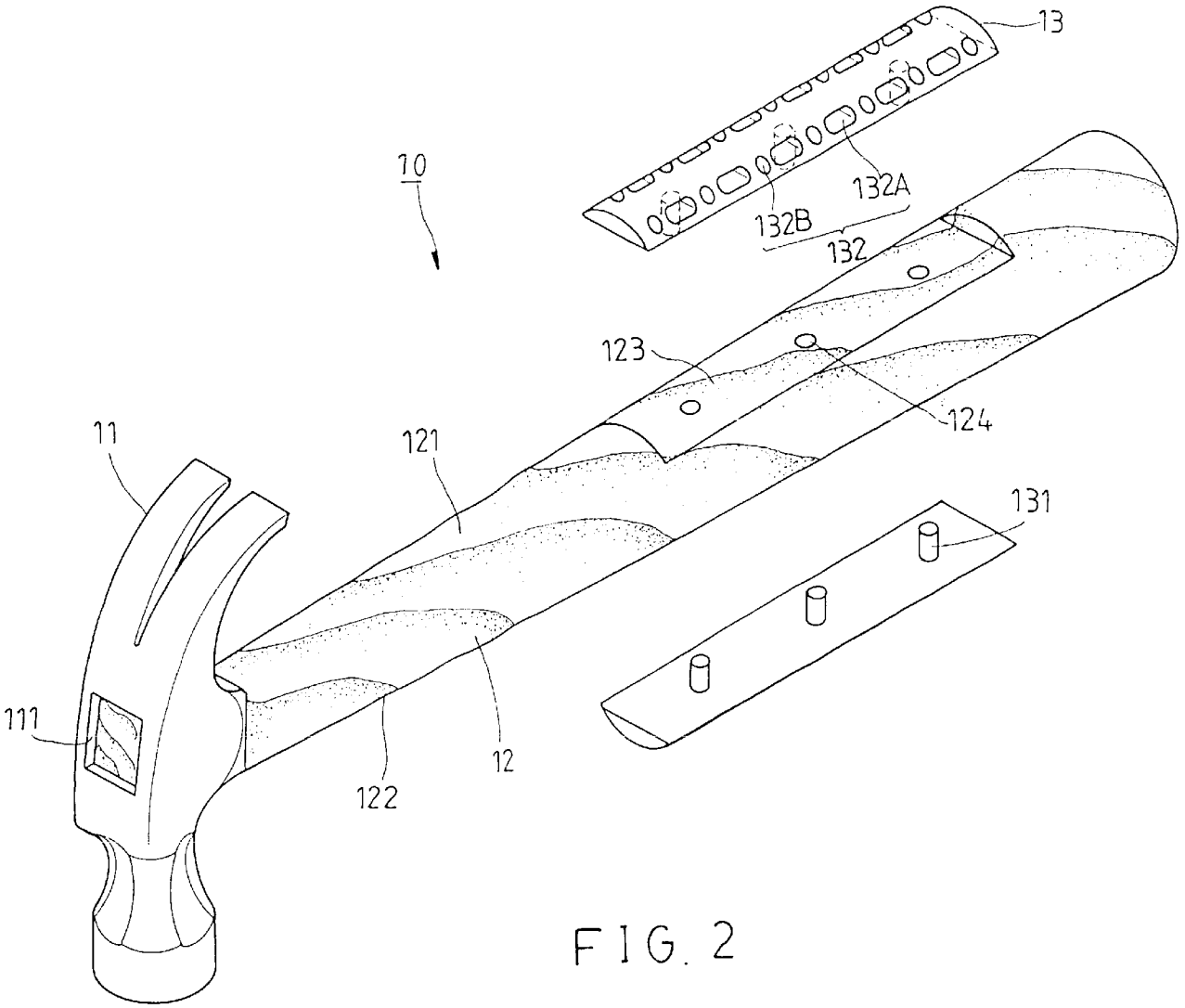
FIG. 2 shows a partial exploded view of a pounding tool of a first preferred embodiment of the present invention.
Figure 4:
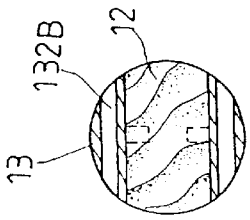
FIG. 4 shows a cross sectional view of a portion taken along the direction indicated by a line 4—4 as shown in FIG. 3.
Figure 3:
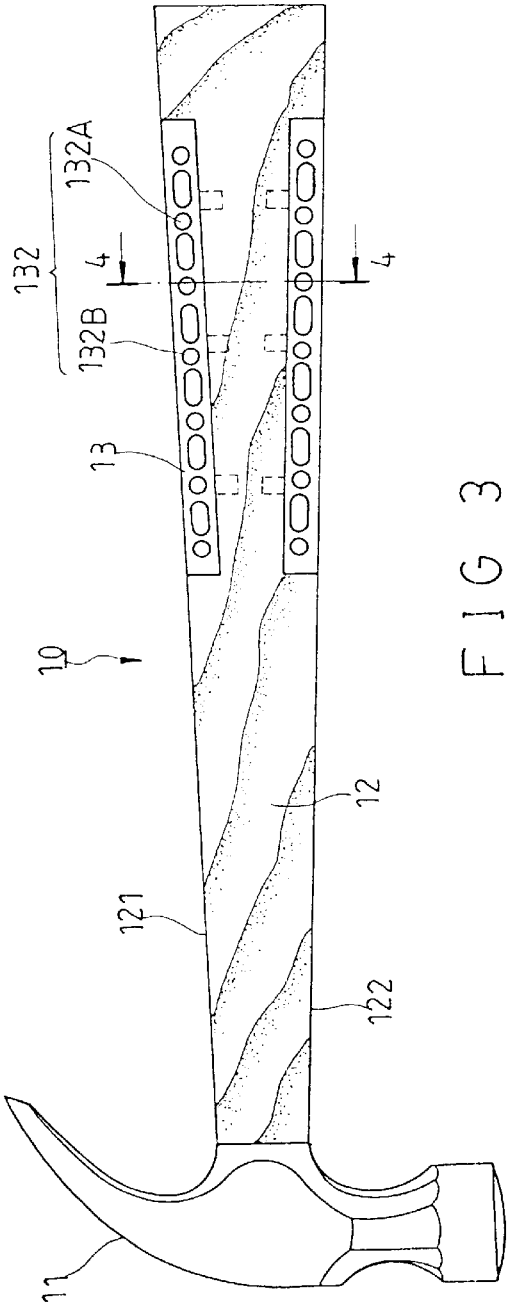
FIG. 3 shows a side view of the first preferred embodiment of the present invention in combination.

As shown in FIGS. 2–4, a pounding tool 10 of the first preferred embodiment of the present invention comprises a pounding body 11, a handle 12, and two shock-absorbing blocks 13.

The pounding body 11 is made of a metal material. The handle 12 is made of a wooden material and is inserted at one end thereof into a connection hole 111 of the pounding body 11. The handle 12 has an upper side 121 and a lower side 122 opposite to the upper side 121. The direction formed from the upper side 121 to the lower side 122 is corresponding to the pounding direction of the pounding body 11. The upper side 121 and the lower side 122 of the handle 12 are respectively provided with a slot 123 which is provided in the bottom wall thereof with three fastening holes 124.

The shock-absorbing blocks 13 are corresponding in size and shape to the slot 123 and are respectively provided with bottom side thereof with three fastening pillars 131 corresponding in form and location to the three fastening holes 124 of the slot 123. Each of the two shock-absorbing blocks 13 is fastened to the handle 12 such that the three fastening pillars 131 are inserted into the three fastening holes 124 of the slot 123 in conjunction with an adhesive. In other words, the upper side 121 and the lower side 122 of the handle 12 are provided with the shock-absorbing block 13, which is further provided with a plurality of through holes 132 arranged in a row along the longitudinal direction of the shock-absorbing block 13. The through holes 132 comprise a plurality of oval through holes 132A and a plurality of round through holes 132B. The through holes 132 are intended to mitigate the reaction force transmitted to the handle 12 from the pounding body 11.

Figure 6:
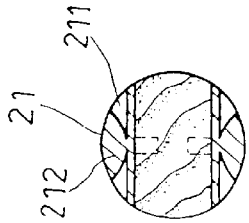
FIG. 6 shows a cross sectional view of a portion taken along the direction indicated by a line 6—6 as shown in FIG. 5.
Figure 5:
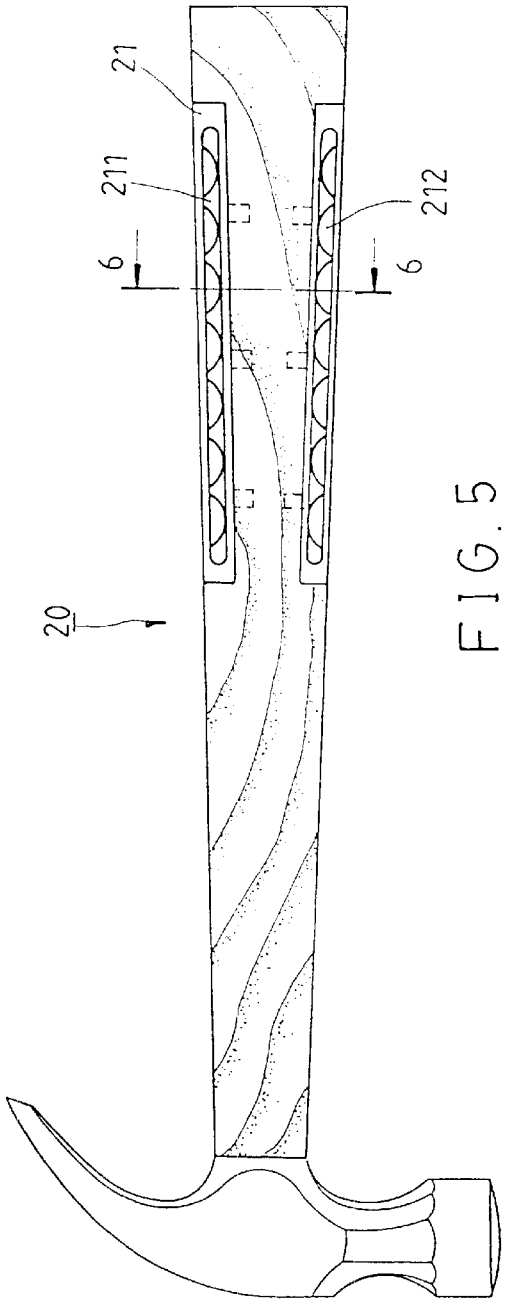
FIG. 5 shows a side view of a second preferred embodiment of the present invention.
Figure 8:
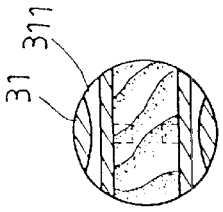
FIG. 8 shows a cross sectional view of a portion taken along the direction indicated by a line 7—7 as shown in FIG. 7.
Figure 10:
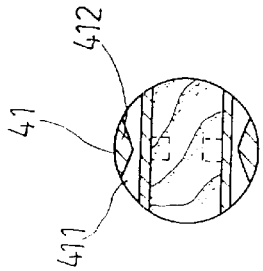
FIG. 10 shows a cross sectional view of a portion taken along the direction indicated by a line 10—10 as shown in FIG. 9.
Figure 7:
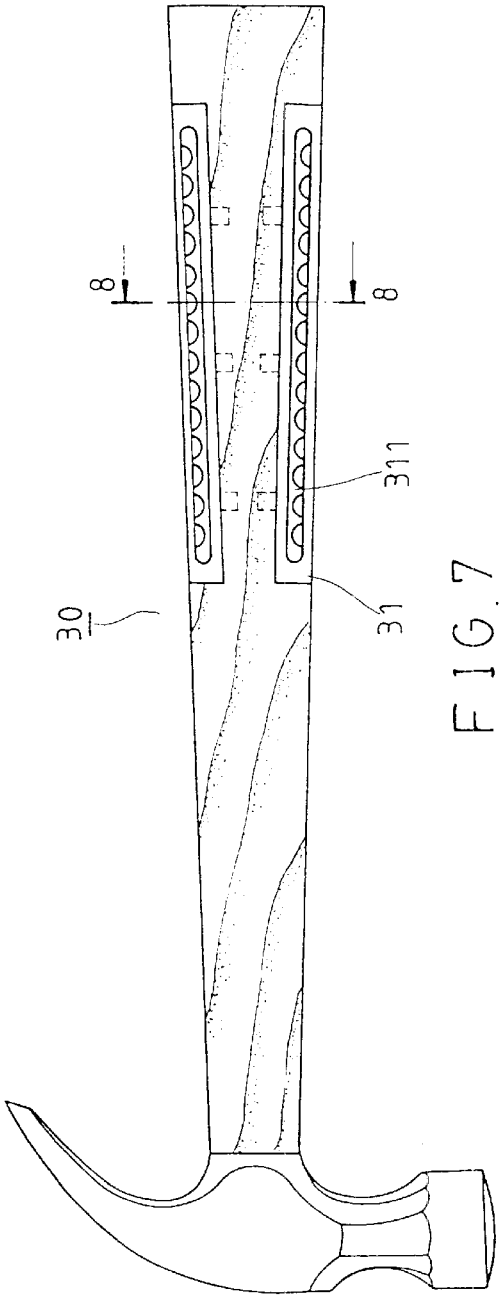
FIG. 7 shows a side view of a third preferred embodiment of the present invention.
Figure 9:
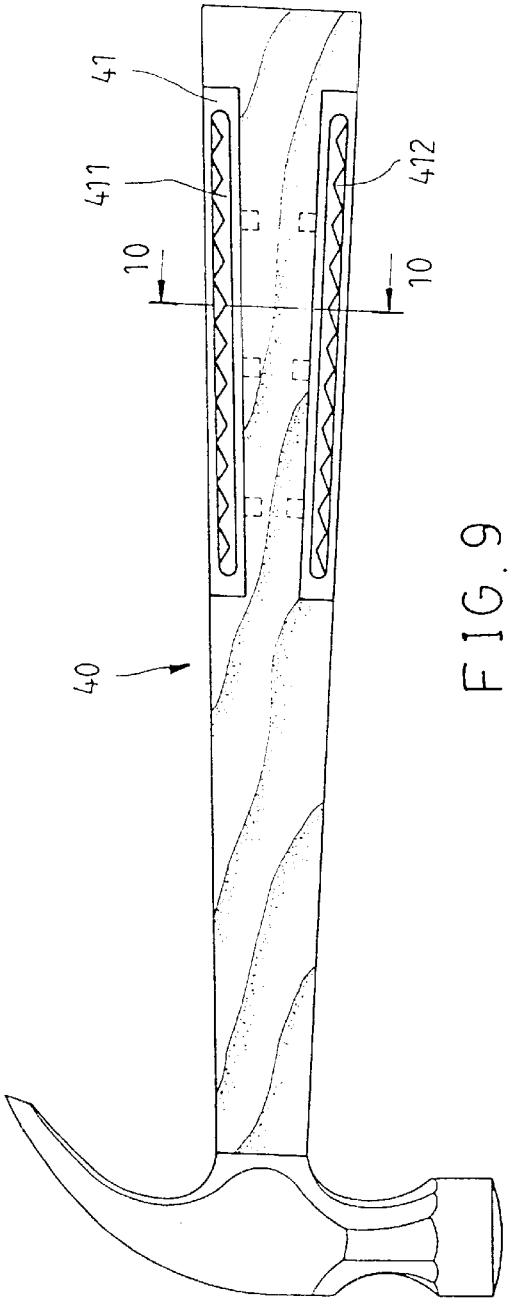
FIG. 9 shows a side view of a fourth preferred embodiment of the present invention.

Now referring to FIGS. 5 and 6, a pounding tool 20 of the second preferred embodiment of the present invention is provided on the handle thereof with two shock-absorbing blocks 21, with each having a plurality of through holes 211 and semicircular partitions 212. A pounding tool 30 of the third preferred embodiment of the present invention is provided on the handle thereof with two shock-absorbing blocks 31 which are provided with a plurality of through holes 311 similar in form to the through holes 211 of the second preferred embodiment described above, except that the through holes 311 are in communication with one another, as shown in FIGS. 7 and 8. A pounding tool 40 of the fourth preferred embodiment of the present invention is provided on the handle thereof with two shock-absorbing blocks 41 which are provided with a plurality of through holes 411 and triangular partitions 412. In other words, the shock-absorbing blocks 41 of the fourth preferred embodiment are similar to the shock-absorbing blocks 21 of the second preferred embodiment, except that the partitions 412 of the fourth preferred embodiment are different in form from the partitions 212 of the second preferred embodiment, as shown in FIGS. 9 and 10.

What is claimed is:

1. A pounding tool comprising:

a pounding body having a pounding head;

a handle fastened at one end thereof with said pounding body so that an axis of the pounding head is substantially perpendicular to a longitudinal axis of the handle;

a pair of slots respectively located opposite each other on an upper and lower side of the handle, each of the slots having a flat bottom wall from which a plurality of fastening holes extend toward the longitudinal axis of the handle;

a distance between each of the slots which is perpendicular to the longitudinal axis of the handle being parallel to the axis of the pounding head;

a pair of shock-absorbing blocks having a plurality of through holes and a plurality of fastening pillars corresponding in form and location to the fastening holes;

wherein said shock-absorbing blocks are respectively engaged in said slots in the upper and lower side of the handle so that the fastening pillars are engaged in the fastening holes.

2. The pounding tool as defined in claim 1, wherein said fastening pillars of said shock-absorbing blocks are engaged with said fastening holes of said slots of said handle in conjunction with an adhesive.

3. The pounding tool as defined in claim 1, wherein said through holes of said shock-absorbing block comprise a plurality of oval through holes and a plurality of round through holes whereby said oval through holes and said round through holes are arranged in a row along a longitudinal direction of said shock-absorbing block.

4. The pounding tool as defined in claim 1, wherein said through holes of said shock-absorbing blocks are in communication with one another.

5. The pounding tool as defined in claim 1, wherein said shock-absorbing blocks are provided with a plurality of partitions arranged alternately with said through holes of said shock-absorbing blocks whereby said partitions have a geometric form.

6. The pounding tool as defined in claim 5, wherein said partitions are semicircular.

7. The pounding tool as defined in claim 5, wherein said partitions are triangular.

8. The pounding tool as defined in claim 1 wherein an axis of each of the through holes is substantially perpendicular to the longitudinal axis of the handle and parallel to the flat bottom walls of the slots so that each of the through holes respectively open on opposite exterior sides of the shock-absorbing blocks.

* * * * *